US006681409B2

(12) United States Patent
Dennis et al.

(10) Patent No.: US 6,681,409 B2
(45) Date of Patent: Jan. 27, 2004

(54) HELMET LINER SUSPENSION STRUCTURE

(76) Inventors: Mike Dennis, 50900 W. Dike Rd., Scappoose, OR (US) 97056; Russell A. Monk, 220 Culver La. South, Salem, OR (US) 97302; Bruce L. Thede, 1020 Schurman Dr. South, Salem, OR (US) 97302

( * ) Notice: Subject to any disclaimer, the term of this patent is extended or adjusted under 35 U.S.C. 154(b) by 0 days.

(21) Appl. No.: 10/121,499

(22) Filed: Apr. 11, 2002

(65) Prior Publication Data

US 2003/0192110 A1 Oct. 16, 2003

(51) Int. Cl.[7] ..... A42B 3/00; A42B 1/22
(52) U.S. Cl. ..... 2/416; 2/418
(58) Field of Search ..... 2/416, 417, 418, 2/419, 420, 421, 6.8, 6.6, DIG. 11, 183, 181.6, 181.4, 182.2, 182.3, 182.6

(56) References Cited

U.S. PATENT DOCUMENTS 2,032,203 A * 2/1936 Dym ..... 2/418
2,431,678 A * 12/1947 Cairns ..... 2/418
2,946,063 A * 7/1960 Boyer ..... 2/418
3,082,428 A * 3/1963 Zbikowski ..... 2/418
3,110,900 A * 11/1963 Crowdes, Jr. ..... 2/419
3,383,705 A * 5/1968 Raschke ..... 2/416
3,388,405 A * 6/1968 Simpson et al. ..... 2/418
3,500,474 A * 3/1970 Austin ..... 2/418
3,513,481 A * 5/1970 Nickerson ..... 2/418
3,628,190 A * 12/1971 Molitoris ..... 2/418
3,714,668 A * 2/1973 Mirabella ..... 2/419
3,758,889 A * 9/1973 Erb ..... 2/416
RE34,699 E * 8/1994 Copeland et al. ..... 2/419

* cited by examiner

*Primary Examiner*—Rodney M. Lindsey
(74) *Attorney, Agent, or Firm*—Jon M. Dickinson, P.C.; Robert D. Varitz, P.C.

(57) ABSTRACT

A unitary helmet liner suspension structure which is designed for easy and quick and correct fitment into differently sized helmet shells whose specific sizes reside within a known and defined range of such sizes.

11 Claims, 3 Drawing Sheets

HELMET LINER SUSPENSION STRUCTURE

BACKGROUND AND SUMMARY OF THE INVENTION

This invention relates to a helmet-liner suspension structure which is selectively installable in the shells of helmets, and in particular, to such a structure which has a universal characteristic that allows it to be quickly, conveniently and fittingly mounted in the shells of helmets that have different sizes within a defined range of sizes. Especially, the invention is designed for use in helmet shells that have a generally common pattern of plural, pre-established and located, spaced attachment sites (referred to as host attachment sites) that have known and predetermined relative locations within the helmet shells that make up the range of sizes mentioned above.

A preferred embodiment of the invention is described herein particularly in the setting of a military helmet shell—a setting wherein the invention has been found to offer particular utility. It should be noted, however, that the invention and its features have utility just as well in other specific and different kinds of helmet shells.

So-called helmet-liner suspension structures play quite large roles in helmet construction and performance, particularly in a field, such as the military field, where closely fitting, position-stable helmets often need to be worn for long, extended time periods. Positional stability, long-term comfort, inherent strength, shock management capability, ease of repair/installation, and if need be quick replacement, of worn or damaged components, and a quality of universality, collectively dominate helmet construction concerns in, for example, the field of the military. Within this field of military helmet shells, all sizes are generally characterized by a common, defined and controlled attachment pattern for securing inside liner suspension structures. Specific relative spacings between attachment sites that have standardized patterns for the different sizes of military helmets are substantially always characterized by a common "locating" attachment host site that is typically located at the rear of a helmet shell. this locating site is usually centered rearwardly on a pattern of plural other attachment sites, typically five other sites, including two such additional sites along either side of a helmet shell, and a central front site.

Within such a family of generally related helmet shells in different sizes, the specific distances that exist between, for example, the lateral side attachment sites for a linear suspension system, and the central rear locating site, differ from helmet-shell size-to-size. Lack of convenient universality and simplicity in relation to matching up suspension structures and helmet shells results in a situation where a specific suspension system needs to be typically prepared and sized for each of the different specific helmet-shell sizes within the range of sizes in such a family of shells. Obviously, this is a fairly expensive proposition, and in circumstances, which often characterize events facing military personnel, inside helmet liner suspensions damaged, and need to be replaced in very quick order, often under difficult field conditions, where speed of assembly and assured fitment of a new liner suspension system in a helmet shell are very important considerations.

Especially important to be taken into account in conjunction with offering any kind of an interior liner suspension system in a helmet shell is that it must perform all of the general utilitarian functions required of such systems, such as the support of contact structure which directly contacts a wearer's head, attachment of additional gear, such as head sets and other paraphernalia that may be required to be attached to a helmet for hands-free wearing and perhaps use, and of course, long-term comfort for the wearer, under circumstances which do not sacrifice positional stability—one of the very important other functional requirements of a liner suspension system. Helmet interior structure is also employed frequently to carry miscellaneous other things, such as maps, notes, letters, etc.

The present invention proposes a helmet liner suspension structure (or system) which substantially meets all objectives, and handily so, that address the various above-expressed important behaviors and characteristics preferably possessed by liner suspension systems. Specifically, the invention distinguishes itself from conventionality, inter alia, by offering universality of fitment and ease thereof, along with clear and quick and simple retrofittably into various already-existing helmet shells having prior art liner suspension systems previously installed. The liner suspension system of the present invention is based upon a careful and sophisticated structural design that maximizes all of the functional qualities expressed above in a single size-adaptive, single-construction suspension unit. It thus truly offers a high-performance internal helmet liner suspension system which can be characterized with the phrase "one size fits all", and with respect to which (a) manufacturing (procedurally) is very simple and quite inexpensive, and (b) installation and surety of proper fitment are easy and confident.

Proposed specifically by the present invention is an elongate unitary band which is formed, as by water-jet cutting or stamping, from an appropriate springy, resilient plastic material such as Dupan Lexan® polycarbonate with a thickness of about 0.060-inches.

This elongate band, in a developed or flattened form, lies substantially flat in a plane with a gentle elongate curvature displayed from end to end.

To install this band, the band is bent to close and overlap its opposite ends upon themselves to form, generally speaking, the appearance of an endless, curved loop in which the bent band per se forms a slightly angularly flaring, closed ovate form. The flaring quality of the bent band gives it the appearance, when it is in an operative condition in a helmet shell, of a small cross-section of a conical structure whose walls slope at a very slight angle upwardly and inwardly all away around the bent and closed band.

In this band, there are provided plural mounting openings, or apertures, (guest affixing sites) including a central locating circular hole, and plural elongate mounting slots. This hole and these slots are designed to match up with the several mounting locations that are provided in the range of helmet sizes to which the present invention is aimed for fitment. In the helmet shells now being discussed, namely, military helmet shells, the locating holes therein for positioning internal liner suspension structures are always centered at the rear of the shell, and typically five other mounting holes are provided, with four of them being positioned as pairs along the opposite lateral sides of the helmet shell, and with the fifth being provided centrally at the front of the shell.

According to an important feature of the present invention, slots that are provided in the band, on opposite sides, so-to-speak, of a central mounting hole, are positioned and given respective lengths whereby, no matter which helmet shell size is chosen for installation of the invention, these slots will always provide clear access to the installation of mounting hardware that effectively passes through the slots of the invention and into the predetermined and pre-located lateral and front mounting holes provided in a helmet shell.

Integrated with the band of the invention are two pairs of downwardly depending, completely integral, chin-strap mounting elements. These elements have generally a flat planar, or bladelike, configuration, and are constructed in such a way that they offer preferential bending along axes contained within their planes and at locations generally downwardly below the main body of the suspension band. These elements, when holding chin-strap structure, permit appropriate bending and flexing so that the tightening of a chin strap with respect to a particular wearer will result in the chin strap seating very securely and very comfortably to the particular wearer's anatomy. The two forward ones of these chin-strap attaching elements, when the device of this invention is in place inside a helmet shell, slope generally downwardly and slightly forwardly in an angle which further aids in comfortable and appropriate fitting of components in a typical chin-strap structure.

In one modified form of the invention, the band therein is formed with one or more elongate spring fingers (spring-finger structure) which are designed to press against the inside surface of a helmet shell. Such fingers allow for the convenient placement and storage of documents, such as maps.

These and various other objectives and advantages that are offered and attained by the present invention will become more fully apparent as the description which now follows is read in conjunction with the accompanying drawings.

DETAILED DESCRIPTION OF, AND BEST MODE FOR CARRYING OUT, THE INVENTION

Figure 1:
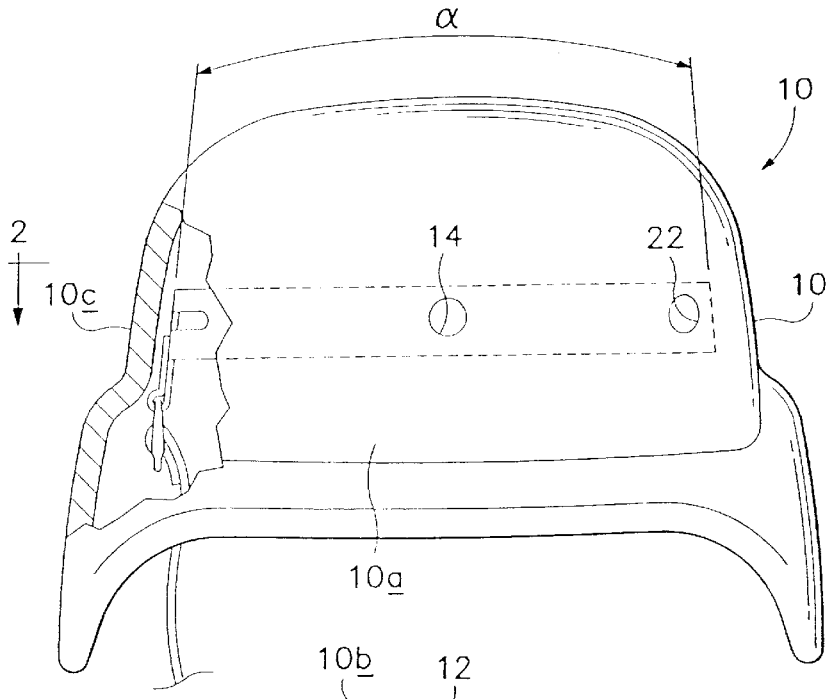
FIG. 1 is a simplified front elevation of a military helmet shell in which there has been installed a universal liner suspension structure made in accordance with the present invention. A portion of this shell has been broken away to illustrate certain details in the interior of the shell.
Figure 2:
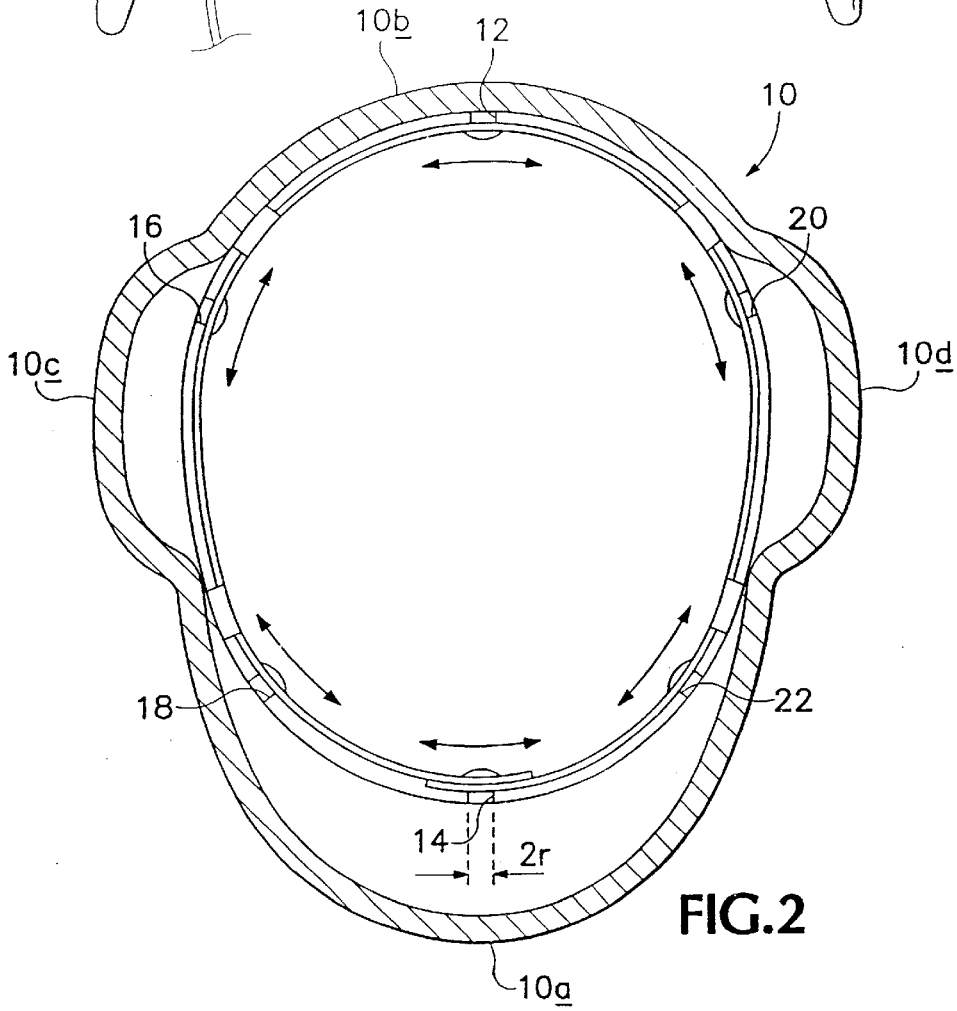
FIG. 2 is a downwardly-looking cross-sectional view taken generally along the line 2—2 in FIG. 1.

Turning now to the drawings, and referring first of all to FIGS. 1–5, inclusive, indicated generally at 10 in FIGS. 1 and 2 is a military helmet shell which is typical of what might be thought of today as a standard-issue military helmet shell made available to many armed forces. Shell 10 includes a front side 10*a*, a rear side 10*b*, and two opposite lateral sides 10*c*, 10*d*. This same helmet shell, while specifically shown in just one size in FIGS. 1 and 2, typically is made available in several different sizes, such as three different sizes.

Provided in shell 10 are plural attachment sites (also called host attachment sites) in the forms of bore holes that have very specifically defined locations in and passing through different points in the shell. Thus, in shell 10 one sees an attachment site 12 which is disposed at the rear of the helmet, and which acts as a locating host attachment site for an internal liner suspension system. The shell also includes a front site 14 which is substantially centrally located in front side 10*a* in the shell, and two pairs of two-each lateral host attachment sites 16, 18, 20, 22 (also referred to herein as other host attachment sites). Within the different sizes of helmet shells with respect to which the particular embodiment of the invention now being described is designed for use, these host attachment sites reside in a very precisely defined and controlled pattern relative to the helmet shell. The front and rear attachment sites can always be described as being positioned centrally (at the appropriate elevation) in the rear and front sides of the shells in this family of shells, respectively. The lateral attachment sites 16, 18, 20, 22 within the different helmet size generally mentioned above, are specifically located at different distances relative to the front and rear shells in the differently-sized helmets, and with respect to each other. However, generally speaking, the pattern of these lateral sites is generically the same for all shells in the group.

Figure 5:
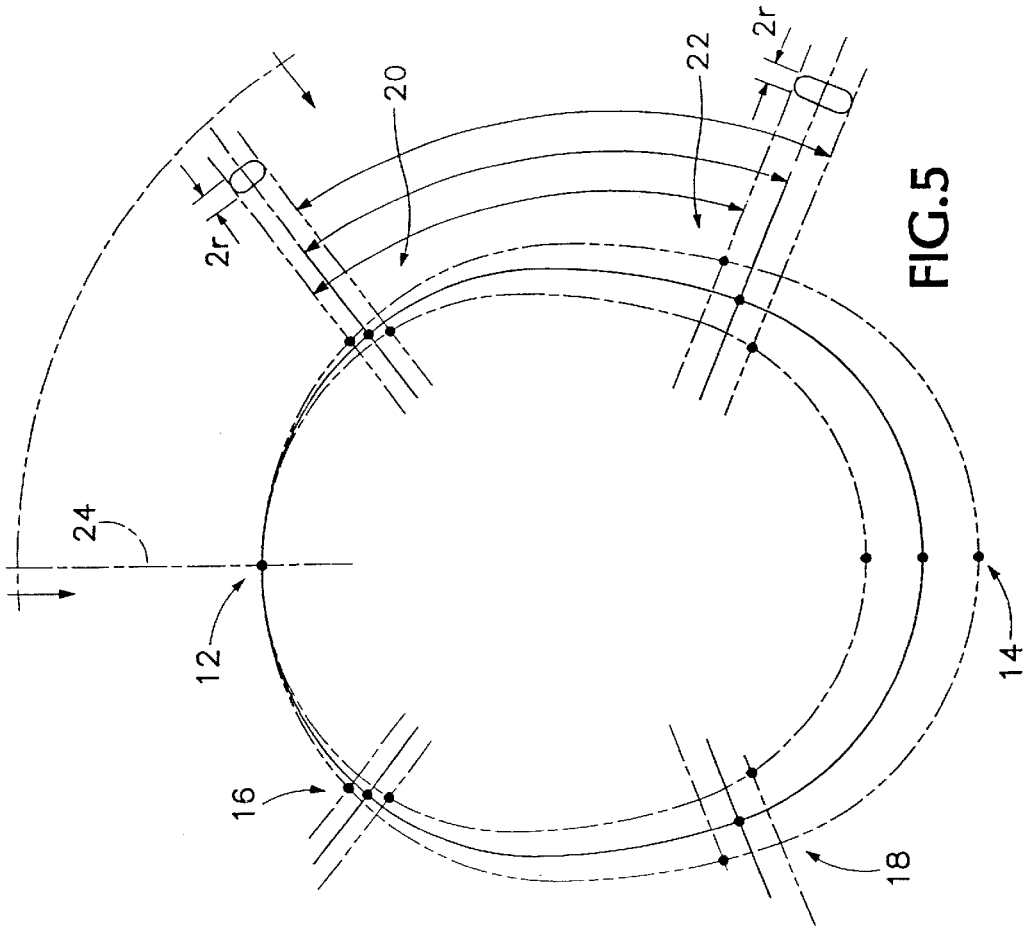

With reference to FIG. 5, solid lines, dash-dot lines, and dash-double-dot lines are presented to represent, schematically, what can be thought of as the respective circumferential locations of the various attachment sites in the three different helmet sizes that were mentioned earlier herein. The solid lines are representative specifically of helmet shell 10. The dash-dot lines related a smaller-size helmet shell, and the dash-double-dot lines, a larger-size helmet shell. Thus, FIG. 5 schematically illustrates the pattern of host attachment sites provided in the three different helmet sizes that are now being considered. One can see, with the respect in the ways in which things are pictured in FIG. 5, that rear locating attachment site 12 is always in the same position. Similarly, the front attaching site 14 is always shown centered at the front of a helmet shell.

Lateral attachment sites 16, 18, 20, 22 are identified as darkened dots through which solid dash-dot and dash-double-dot straight lines pass to reflect the similar but specifically different locations for lateral guest attachment sites provided in the three helmet sizes now being discussed. Thus, one can see that for the largest size helmet shell (dash-double-dot lines), the black dots representing these lateral attachment sites are relatively closer to rear attachment site 12 than are the companion attachment sites provided in the larger size helmets. Those in the central size helmet shell (solid lines) are positioned a little bit further respectively from the rear attachment site, and those in the smallest helmet size (dash-dot lines), are respectively further from rear attachment site 12. One can also see that the spacings between the associated pairs of lateral sites in the three different helmet sizes, differ from size to size, with the spacing between the two lateral attachment sites on one side of the helmet being large for the largest size helmet shell, somewhat smaller for the intermediate size helmet shell, and even slightly smaller for the smallest size helmet shell.

It is to accommodate this pattern of differently spaced, through somewhat like in pattern, attachment sites that the present invention is specifically aimed.

Figure 4:
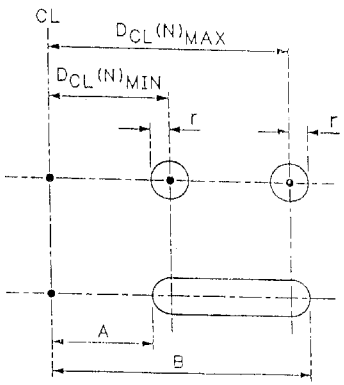
FIGS. 4 and 5 are schematic diagrams which help to illustrate and describe how mounting apertures in the suspension structure of the invention are sized and positioned in order to accommodate a known range of helmet sizes with respect to which this particular embodiment of the invention has been designed for use.

Referring now to FIG. 4 specifically along with FIG. 5, the upper portion in FIG. 4 is helpful in understanding how one can characterize the respective different spacings between attachment sites in the three different helmet-shell sizes. Rear attachment site 12 is circular, and has a center line shown in FIG. 5 by dash-dot line 24. The radius of site 12 is represented herein by a radial dimension r. All of the other host attachment sites are also circular, and each has a radius of curvature r. Center lines for these other sites are shown by short lines intersecting the related darkened dots in FIG. 5. In FIG. 4, the reference character CL represents line 24 in FIG. 5.

The distance between the center line of attachment site 12 and the center line of, for example, attachment site 20, in the smallest of the three helmet shells can be described as the actual distance which exists between the closest points in sites 12 and 20 increased by two times by the radii of curvature r. This is represented in FIG. 4 by the variable $D_{CL}(N)_{MIN}$. The same distance which exists between attachment site 12 and site 20 in the largest helmet now being considered is described in FIG. 4 by the variable $D_{CL}(N)_{MAX}$. And one can see that the farthest point in the hole that makes up site 20 lies at a distance from CL which is equal to the actual distance between the center lines of sites 12 and 20 enhanced by the addition of radius r. Since these two dimensional distances effectively define the range of location sites that needs to be accommodated by the present invention, it will be apparent that whatever is provided in the suspension of the present invention to deal with this different set of spacings between sites 12, 20 needs to have an overall length which, as pictured in the lower part of FIG. 4, takes the form of a long slot, the near end of which lies at a distance A from the center line of attachment site 12, and the far end of which lies at a distance B in FIG. 4. The same kind of dimensional relationship exists with a range of distances between site 12 and site 22 for the different helmet sizes, and the range of sizes or locations that needs to be accommodated is the same for both lateral sides of all helmet shells in the group of three different sizes now being discussed.

The suspension of the present invention takes this into account by furnishing slot openings, as will now shortly be described, which, no matter in which size helmet shell the suspension structure of the invention is to be placed, will fully expose for attachment, whatever is the actual set of locations of the lateral attachment sites in the shell.

Figure 3:
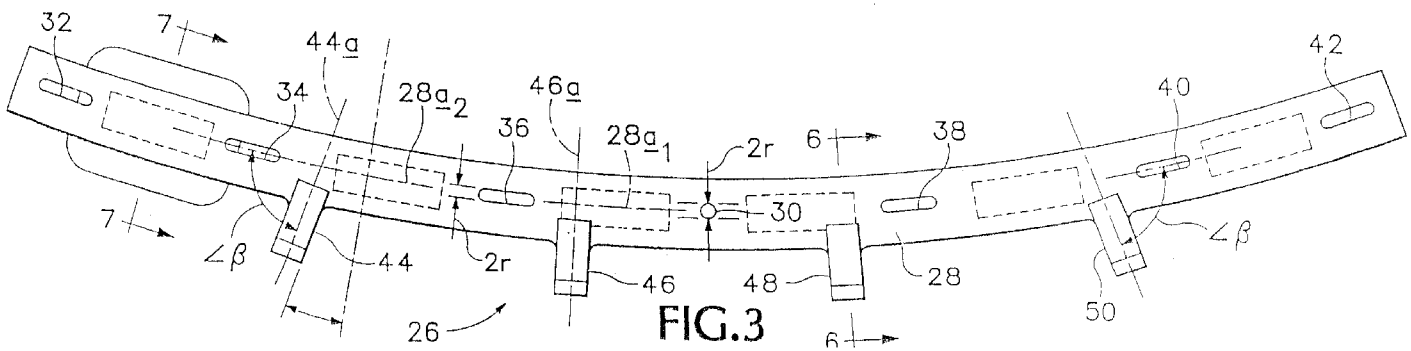
FIG. 3 is a developed (flattened) view of the suspension structure of the present invention.

Focusing attention now on FIG. 3, the manner in which the structure of the present invention deals with this size range issue is clearly evident.

Accordingly, shown at 26 in FIG. 3 is an interior helmet-liner suspension structure built in accordance with the present structure. This structure is a unitary structure preferably made of the plastic material mentioned earlier herein, and preferably formed, initially, by water-jet cutting of the developed outline shape of structure 26 out of a flat sheet of this plastic material. Other manufacturing techniques can be used, but water-jet to cutting has proven itself to be extremely effective, easy and inexpensive. As can be seen in FIG. 3, structure 26 includes an elongate, slightly arcuate, planar band 28 through which there are formed plural apertures including a central circular aperture 30, and six elongate slot apertures 32, 34, 36, 38, 40, 42. Aperture 30, referred to herein as an anchor-accommodating guest affixing site, is designed to align with the rear attachment site 12 in a helmet shell. In FIGS. 1 and 2, it is shown so attached. Slot apertures 34, 36 are intended to align with mounting sites 22, 20, respectively, and slot apertures 38, 40 are intended to align universally with mounting sites 16, 18, respectively, in a helmet shell. The specific locations of these slot apertures is determined in accordance with the discussion just held earlier in relation to what is shown in FIG. 4. Slot apertures 32, 40 are intended to overlap with one another and to provide attachment access under all size condition to front mounting site 14 in a helmet shell.

Figure 6:
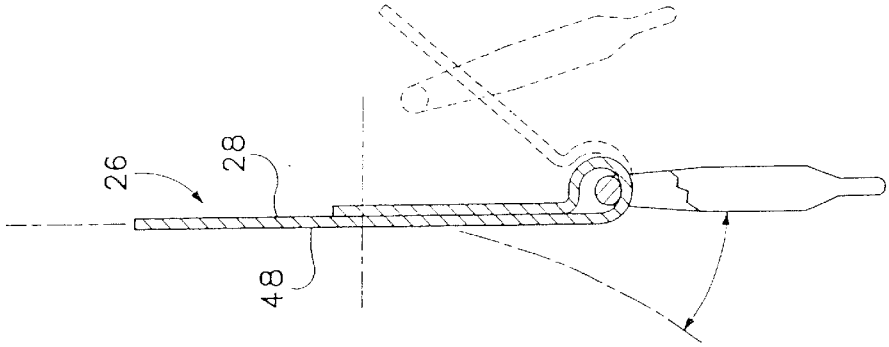
FIG. 6 is an enlarged fragmentary cross-section taken generally along the line 4—4 in FIG. 3. The provisions for certain motions are pictured in this view.

Further describing what is contained in the suspension structure 26 of this invention, and linking attention now to FIG. 6 along with FIG. 3, formed integrally with band 28, and extending downwardly therefrom as generally pictured in FIG. 3, are four elongate, blade-like, chin-strap attachment components (or elements of mounts) 44, 46, 48, 50 which have the configurations clearly illustrated for them in the drawings. These elements, which act like clips or catches, are formed in structure 26 originally as elongate blade-like fingers which lie flat on a surface, and which are then formed, as by applying heat and employing suitable bending and/or shaping tools, to produce a folded-back longitudinal cross-sectional configuration clearly illustrated in FIG. 6. In this condition, they can be opened for the receipt of suitable end fasteners on chin straps as is generally pictured by the moved-position dashed lines in FIG. 6. Specifically, they can be opened against resistive spring-action in the elastic material which makes up structure 26, whereupon, after attachment, they spring back into place to hold a chin strap assembly in place. Significantly, and as is indicated by the curved dash-dot line, and by the double-ended curved arrow in FIG. 6, when a wearer cinches down or tightens and adjusts a chin-strap structure, the catch components flex generally in a preferential bending plane which is essentially the plane of the part that extends directly from band 28, and they do this while imparting no appreciable deformation to the band itself, thus to accommodate, very comfortably a fit with the side of a wearer's head and the wearer's chin.

Figure 7:
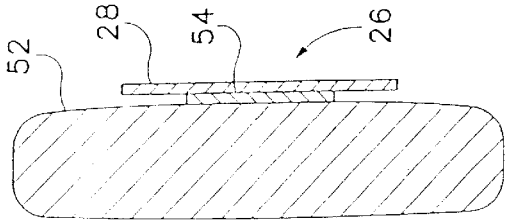
FIG. 7 is a simplified cross-section, on about the same scale employed in FIG. 6, illustrating how a band in the suspension structure of the present invention can be employed to support internal cushioning structure that will sit directly against the head of a wearer.

FIG. 7 in the drawings just generally illustrates how what turns out to be the inside surface expanse of band 28, when structure 26 is in place inside a helmet shell, can be employed for the attachment of various objects, such as the cushioning structure shown at 52 in FIG. 7. While various different attachment mechanisms can be used herein, in the illustration now being given, cushioning structure 52 is releasably attached to the inside surface of band 28 through a convention hook-and-pile fastener, usually sold under the trademark Velcro®. Such a fastener is shown at 54 in FIG. 7.

Focusing again specifically on FIG. 3, and on chin-strap mounts 46, 44, the long axis 46*a* of mount 46 is disposed substantially at a right angle relative to what is referred to herein as the local long axis 28*a* of band 28. The long axis 44*a* of mount 44, however, is not disposed at a right angle relative to the local long axis 28*a* of band 28. Axes 44*a*, $28a_2$ intersect at an acute angle β, which herein is slightly less than 90°. This results in a condition, when band 28 is installed in a helmet shell, wherein mount 44 inclines slightly downwardly/forwardly relative to a helmet shell.

Chin-strap mounts 48, 50 have axes orientations like those just described for mounts 46, 44, respectively.

The downward and forward angular conditions of mounts 44, 50 contribute significantly to wearer comfort.

Figure 9:
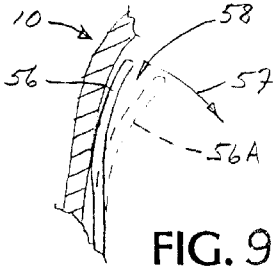
FIG. 9 is a fragmentary view taken as if along line 9—9 in FIG. 8 under circumstances with the suspension structure of FIG. 8 installed inside a helmet shell.
Figure 8:
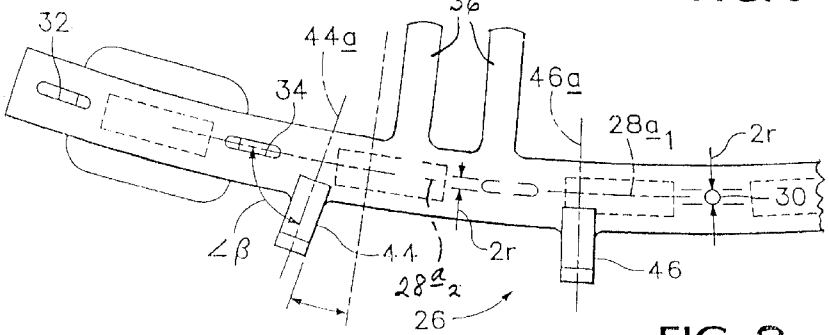
FIG. 8 is similar to FIG. 3, except that it shows a modified form of a suspension structure constructed in accordance with the present invention to include paper- or document-holding spring fingers.

FIGS. 8 and 9 illustrate a modified form of the invention wherein, formed integrally with band 28 are two closely laterally spaced, elongate, blade-like spring fingers 56, also referred to herein as spring-finger structure. These fingers, which extend as shown angularly away from the local long axis $28a_2$ of band 28, generally opposite the direction of extension of components 44, 46, 48, 50, become bent and resiliently pressed against the inside of a helmet shell when the suspension structure of this invention is installed in such a shell. This condition is pictured clearly in FIG. 9. A wearer of a helmet shell so equipped can easily pry fingers 56 away from shell contact (see curved arrow 57 and the dashed lines at 56A in FIG. 9), and insert, for carrying and retention within the helmet shell, a document (or documents) as indicated by arrow 58 in FIG. 9.

Accordingly, a helmet liner suspension structure is proposed by the present invention which has the quality of universality, and the other desirable qualities, discussed earlier herein.

While the invention has been disclosed in a particular setting, and in particular forms herein, the specific embodiments disclosed, illustrated and described herein are not to be considered in a limiting sense. Numerous variations, some of which have been discussed, are possible. Applicants regard the subject matter of their invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as useful, novel and non-obvious. Other such combinations and subcombinations of features, functions, elements and/or properties may be claimed through amendment of the present claims or through presentation of new claims in this or in a related application. Such amended and/or new claims, whether they are broader, narrower or equal in scope to the originally presented claims, are also regarded as included within the subject matter of applicants' invention.

We claim:

1. A universal helmet-liner suspension structure selectively installable in a fixed and positionally stabilized condition inside, and directly to, the shells of helmets which are characterized by different sizes in a defined range of sizes, and wherein such shells have a generally common pattern of plural, pre-established and located, spaced host attachment sites with respect to which different pairs of adjacent such sites have differing specific spacings that differ in a known way in relation to helmet-shell size, and wherein said host attachment sites includes a rear, central locating host attachment site, and additional, other host attachment sites, said structure comprising an elongate, resilient band having a long axis and opposite ends, said band being bendable, and selectively closable upon itself, to form a generally-closed, endless, curved loop fittable, in a universal manner, closely within the insides of the shells in such helmets, and throughout the mentioned range of helmet sizes, and spaced, anchor-accommodating, guest affixing sites furnished in said band, including (a) a longitudinally central, position-locating guest affixing site which is commonly and substantially identically employable with the rear, central locating host attachment sites in all such helmet shells to anchor said band in place and in a positionally stabilized manner in such shells, and (b) plural, range-accommodating, other guest affixing sites which freely accommodate attachable fitment of the band, on a one-to-one basis, at the respective locations of said other host attachment sites in such shells.

2. The structure of claim 1, wherein said affixing sites comprise spaced apertures formed in and distributed along said band.

3. The structure of claims 1 or 2 which further includes plural distributed chin-strap mounts formed integrally with said band.

4. The structure of claims 1 or 2 which further includes elongate article-retainer spring-finger structure formed integrally with, and extending angularly away from the long axis, of said band.

5. The structure of claim 4, wherein said spring-finger structure includes a pair of elongate, side-by-side adjacent spring fingers.

6. The structure of claim 5, wherein each of said spring fingers has a blade-like configuration.

7. The structure of claim 3, wherein said chin-strap mounts each takes the form of an elongate, projecting and depending, flexible, generally blade-like element which has a preferential bending characteristic, and which is constructed to accommodate bidirectional, elastic-mode bending and flexing, according to said preferential bending characteristic, generally radially inwardly relative to a curved loop formed by said band when the band is closed upon itself.

8. The structure of claim 7, wherein said band's said long axis includes regions distributed along its length each referred to as a local long axis, and said chin-strap mounts include at least one pair of mounts, each of which mounts in said at least one pair has a long axis that generally intersects a local long axis region of said band's long axis at an angle which is other than a right angle.

9. The structure of claim 8 which, under circumstances where the structure is installed in a helmet, with the band closed upon itself to form a curved loop, has a front side relative to the front side of the shell wherein the structure is installed, and said long axes of said mounts in said at least one pair of mounts extend at generally forwardly- and downwardly-facing acute angles relative to the mentioned associated local long axis of said band, and with general bilateral symmetry relative to the front side of the helmet shell.

10. The structure of claims 1 or 2, wherein said band's said long axis includes regions distributed along its length each referred to as a local long axis, and said other guest affixing sites take the forms of elongate through-slots having long axes generally paralleling the adjacent, local long axis of said band.

11. The structure of claim 1, wherein said position-locating site takes the form of a circular aperture, and said range-accommodating sites each takes the form of an elongate slot having a long axis which generally follows the long axis of said band.

* * * * *